US006283225B1

(12) United States Patent
Hermonson

(10) Patent No.: US 6,283,225 B1
(45) Date of Patent: Sep. 4, 2001

(54) GRADER ATTACHMENT FOR A SKID STEER VEHICLE

(76) Inventor: Richard P. Hermonson, 11783 Coon Trail Rd., Harvard, IL (US) 60033

( * ) Notice: Subject to any disclaimer, the term of this patent is extended or adjusted under 35 U.S.C. 154(b) by 0 days.

(21) Appl. No.: 09/477,324

(22) Filed: Jan. 4, 2000

(51) Int. Cl.[7] ..... E02F 3/76

(52) U.S. Cl. ..... 172/817; 172/830; 172/834; 37/271

(58) Field of Search ..... 172/783, 786, 172/787, 788, 795, 798, 828, 834, 817, 930; 37/266, 270, 271, 231, 235, 236

(56) References Cited

U.S. PATENT DOCUMENTS

| | | | | |
|---|---|---|---|---|
| 3,435,546 | * | 4/1969 | Iverson . | |
| 3,561,538 | * | 2/1971 | Curlett et al. | 172/798 X |
| 3,611,594 | | 10/1971 | Blackman | 37/1 |
| 3,957,130 | | 5/1976 | Hammersmith | 180/159 |
| 4,244,662 | * | 1/1981 | Olson | 172/787 X |
| 4,936,392 | | 6/1990 | Kitchin | 172/815 |
| 5,497,569 | | 3/1996 | Byman | 37/410 |
| 5,529,131 | | 6/1996 | Van Ornum | 172/189 |
| 5,560,129 | | 10/1996 | Rothbart | 37/231 |
| 5,666,794 | | 9/1997 | Vought et al. | 56/15.2 |
| 5,701,693 | | 12/1997 | Brocious et al. | 37/381 |
| 5,775,438 | | 7/1998 | Confoey et al. | 172/831 |

* cited by examiner

*Primary Examiner*—Christopher J. Novosad
(74) *Attorney, Agent, or Firm*—Andrus, Sceales, Starke & Sawall, LLP

(57) ABSTRACT

A grader attachment for a skid steer vehicle. The grader attachment is attachable to the front end of the skid steer vehicle. The grader attachment includes a mounting plate at the rear of the grader attachment for removably attaching the grader attachment to the lift mechanism of the skid steer vehicle. The grader attachment further includes a frame with a plurality of frame members extending longitudinally from the mounting plate in parallel spaced relation for accepting at least three grading blades attached to and extending downwardly from the frame members. The grading blades include a first blade located at the front end of the grader attachment, the first blade angled inwardly from right to left to output a windrow from the left end of the first blade. A second blade is located behind the first blade and positioned to accept the windrow from the first blade, the second blade angled inwardly from left to right to produce a windrow on the right end of the second blade. A third blade is located behind the second blade and positioned to accept the windrow from the second blade, the third blade angled inwardly from right to left to produce a windrow on the left end of the blade. The grader attachment further includes a guide wheel located at the front of the grader attachment, the guide wheel hydraulically powered by a hydraulic cylinder and used for raising and lowering the front end of the grader attachment.

11 Claims, 3 Drawing Sheets

GRADER ATTACHMENT FOR A SKID STEER VEHICLE

BACKGROUND OF THE INVENTION

The present invention relates to grading equipment, and more particularly to a grader attachment which is removably attached to the front end of a skid steer vehicle for landscaping, leveling, smoothing, grading and spreading dirt, sand, gravel and the like on non-paved surfaces.

Skid steer vehicles are known to provide a high degree of maneuverability and a wide range of applications in the agricultural, industrial and construction fields. The size and maneuverability of the skid steer vehicle make them highly useful for a wide variety of applications. These vehicles generally include an engine, a boom assembly and an operator's cab mounted to a main frame supported by four wheels. A main drive system is coupled to the engine. The skid steer vehicle is operated by an operator seated within the operator's cab and by actuating a pair of steering levers, typically positioned to the left and right sides of the operator. The left lever controls the rotation of the pair of wheels on the left side of the skid steer vehicle and the right lever controls the rotation of a pair of wheels on the right side of the skid steer vehicle.

The boom assembly typically includes a pair of load arm assemblies pivotally mounted to the main frame or a support frame extending upwardly therefrom. Material handling attachments such as a bucket or other working attachments are usually mounted on the forward end of the load arm assemblies. A hydraulic system is usually employed to power the boom assembly between raised and lowered positions via hydraulic cylinders coupled to the load arm assemblies. Typically, a pair of hand or foot controls installed in the operator's cab control the flow of hydraulic fluid to the load arm cylinders.

Besides material handling buckets, various other attachments such as pallet forks, earth augers, backhoes, trenchers, etc., are commonly mounted to the boom assembly. An auxiliary hydraulic system is often used to control the flow of hydraulic fluid between a pump on the frame of the skid steer vehicle and a hydraulic motor in the vicinity of the front-mounted attachment. It is the usual practice in the prior art for the flow of hydraulic fluid to be channeled from the pump to the hydraulic motor associated with the attachment by means of a plurality of hydraulic tubes which are generally directed along the load arm assemblies to the attachment. Alternatively, the attachments may also be connected to the main hydraulic system of the skid steer vehicle.

Prior art grading equipment typically includes a tractor, road grader, bulldozer, or front end loader having a single blade mounted to the front end or center of the grading equipment. This equipment may include different sized blades extending in various configurations. However, their applications have been limited and the range of motion of the blades are generally restricted. The prior art grading equipment utilizing only a single blade requires multiple passes of the grader over an area to be graded. This results in wasted time, increased wear and tear on the equipment, and operator fatigue.

The blade configuration of the present invention requires only a single sweep of the grading area to provide the desired surface, and thereby reducing the time and cost associated with creating a parking lot, driveway or the like. The grader attachment of the present invention is thus very useful and cost effective for grading driveways, parking lots or the like.

SUMMARY OF THE INVENTION

The present invention provides a grader attachment which removably attaches to the front end of a skid steer vehicle. The grader attachment is removably attached to an attachment mechanism at the forward end of a pair of load arm assemblies extending from a boom assembly of the skid steer vehicle. The attachment mechanism includes a mounting assembly that rotates about a pivot pin at the free ends of the load arms. The mounting assembly attaches to the rear end of the grader attachment in a conventional manner as is known in the art.

The grader attachment comprises a frame member with a plurality of grading blades attached to and extending downwardly from the bottom of the frame member. The frame member includes a mounting plate attached to the rear end of the frame and at least one guide wheel attached to the front end of the frame. The frame further includes a plurality of frame members extending longitudinally in parallel spaced relation between the mounting plate at the rear end of the frame and a guide wheel support structure located at the front end of the frame. Each frame member is preferably of a tubular construction.

Attached to the opposite side of the mounting plate is a pair of support members in parallel spaced relation for attaching the mounting plate to the frame. The support members provide additional structural support to the mounting plate attached to the front end of the frame.

Attached to the guide wheel support structure at the front of the frame is at least one guide wheel which is used to lift the front end of the grader attachment off the ground. The guide wheel is hydraulically powered by a hydraulic cylinder mounted between the guide wheel support structure and a vertically extending support member extending upwardly from one of the frame members. Activation of the hydraulic cylinder causes the wheel to be moved inwardly closer to the front of the grader attachment or outwardly away from the grader attachment for raising and/or lowering the front end of the attachment. A supply line arrangement delivers hydraulic fluid to the hydraulic cylinder. The hydraulic cylinder pushes the wheel down to lift the front end of the grader attachment off the ground. A plurality of grading blades are rigidly attached to the bottom of the frame members. A first blade is positioned at the front of the attachment and located behind the guide wheel. The first blade is angled inwardly from right to left so that the dirt material flows from right to left and exits the left end of the blade. A second blade located behind the first blade is positioned to accept the windrow from the first blade and is angled from left to right to push the windrow of the right end of the second blade. A third blade includes an extension on its right end to pick up the windrow from the second blade. The third blade is angled inwardly from right to left at an angle substantially equal to the angle of the first blade. The configuration of the three blades are preferably fixed, but may be adjustable for different applications.

The grader attachment may also be attached to the front end of a skid steer vehicle having a pair of lifting forks attached thereto for attachment in the frame members opposite the center frame member. The flame members are hollow to allow insertion of the lifting forks. The distance between the right and left frame members is substantially equal to the distance between the right and left lifting forks so that the frame members are in alignment with the lifting forks.

Various other features, objects, and advantages of the invention will be made apparent to those skilled in the art from the following drawings and detailed description of the invention.

DETAILED DESCRIPTION OF THE INVENTION

Figure 1:
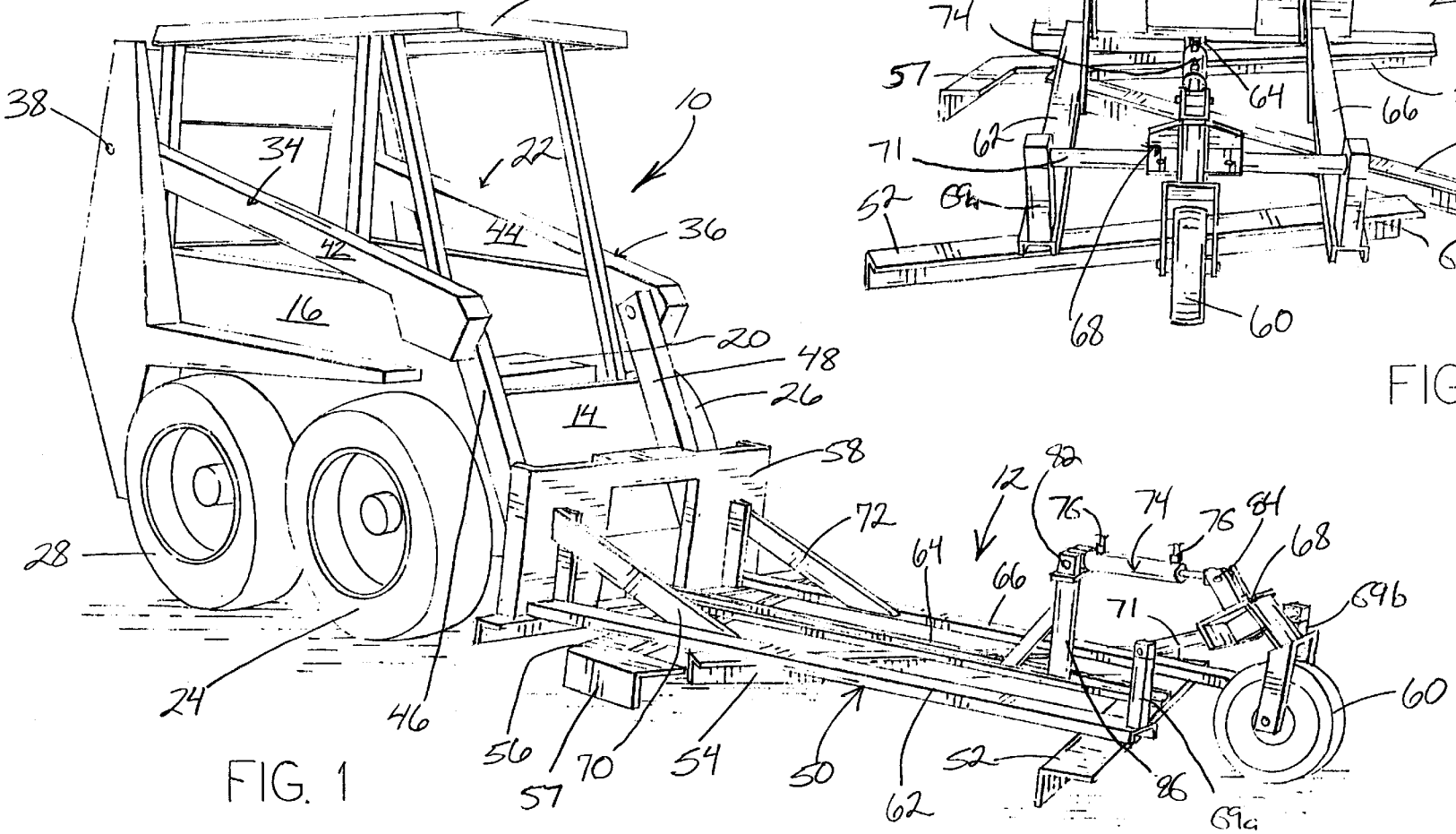
FIG. 1 is a perspective view of a grader attachment attached to the front end of a skid steer vehicle in accordance with the present invention.

FIG. 1 shows a skid steer vehicle 10 and a grader attachment 12 attached to the front end 14 of the skid steer vehicle 10. The skid steer vehicle 10 includes a main frame 16, an engine (not shown) disposed within frame 16, an operator's cab 20 and a boom assembly 22 all of which are supported by a pair of front wheels 24, 26 and rear wheels 28, 30 rotatably mounted on the frame 16. The operator's cab 20 includes a roof and rollover protection structure 32 as is known in the art. The boom assembly 22 comprises a pair of spaced apart load arm assemblies 34, 36. Each load arm assembly 34, 36 is pivotally mounted to pivots 38, 40 on the upper rear portion of frame 16, with the opposite end of each load arm assembly 34, 36 supporting and attaching to the grader attachment 12.

Each load arm assembly 34, 36 includes an upper load arm section 42, 44 and a lower load arm section 46, 48 pivotally connected to the upper load arm section 42, 44. As seen best in FIG. 1, the upper load arm sections 42, 44 extend downwardly and forwardly between pivots 38, 40 at the upper rear portion of the frame 16 and the operator's cab 20, and the lower load arm sections 46, 48 extend mostly downwardly and slightly forwardly in front of the operator's cab 20 for attaching to the grader attachment.

Figure 5:
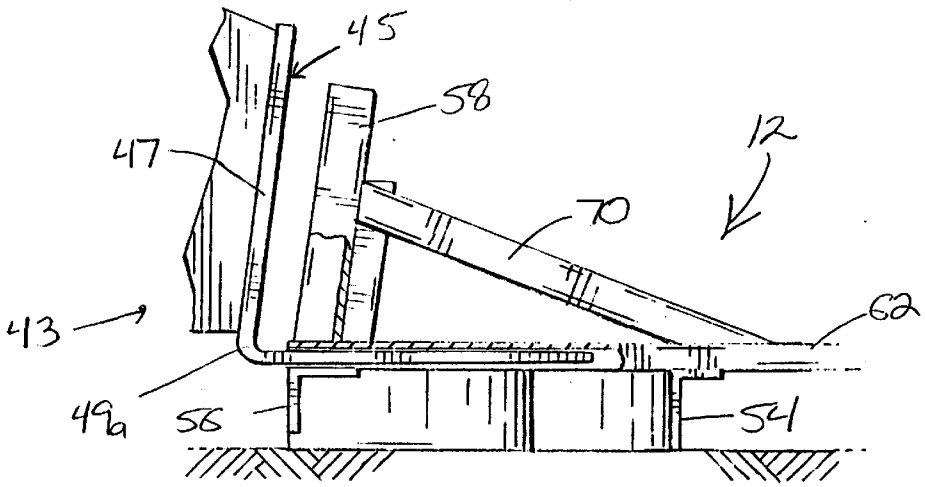
FIG. 5 is a partial side elevational view of the grader attachment being attached to the front end of a skid steer vehicle equipped with a pair of lifting forks.

Referring now to FIG. 5, the grader attachment 12 is removably attached to an attachment mechanism 43 at the forward end of each load arm assembly 34, 36. The attachment mechanism 43 includes a mounting assembly 45 that rotates about a pivot pin (not shown) at the free ends of the lower load arm sections 46, 48 in a conventional manner as is known in the art. The mounting assembly 45 may be, for example, a fork lift attachment including a stop plate 47 and a pair of lifting forks 49 that attach to the rear end of the grader attachment 12. The distance between the right and left frame members 62, 66 is substantially equal to the distance between the right and left lifting forks 49*a*, 49*b* so that the grader attachment 12 is in alignment with the mounting assembly 45.

The grader attachment 12 comprises a frame 50 with a plurality of grading blades 52, 54, 56 attached to and extending downwardly from the bottom of the frame 50. The frame 50 includes a mounting plate 58 attached to the rear end of the frame 50 and at least one guide wheel 60 attached to the front end of the frame 50. The frame 50 further includes a plurality of frame members 62, 64, 66 extending longitudinally in parallel spaced relation between the mounting plate 58 at the rear end of the frame. Each frame member 62, 64, 66 is preferably a tubular construction. The frame also includes a guide wheel support structure 68 at the front end of the frame 50. The guide wheel support structure 68 includes a pair of support arms 69*a*, 69*b* upwardly extending from the front ends of frame members 62 and 66. A bar 71 extends between the upper ends of support arm 69*a* and 69*b* and is attached to guide wheel support structure 68 at the center of bar 71. The support structure 68 includes a tubular housing 73 that receives a mounting portion (not shown) disposed at one end of a U-shaped bracket 75 to which the wheel 60 is attached. The mounting portion is inserted within the housing 73 and rotatably retained therein such that the wheel 60 may turn with respect to the grader attachment 12 in response to a turn made by the skid steer vehicle 10.

Attached to the mounting plate 58 between the plate 58 and frame members 62 and 66 is a pair of support members 70 and 72 in parallel spaced relation for attaching the mounting plate 58 to the frame 50. The support members 70 and 72 provide structural support to the mounting plate 58 attached to the front end of the frame 50.

A hydraulic cylinder 74 powered by connections 76 connected to the skid steer vehicle 10 is used to lift the front end of the grader attachment 12 off the ground at the end of a pass. The hydraulic cylinder 74 includes a rod portion 78 telescopically mounted in a cylinder portion 80. The cylinder portion 80 is pivotally connected to a pivot point 82 on the frame 50 and the rod portion 78 is mounted to a pivot point 84 located on the wheel support structure 68. The connections 76, depicted as a pair of hydraulic tubes in FIG. 1, deliver hydraulic fluid from the vehicle 10 to the hydraulic cylinder 74. It should likewise be appreciated that the connections 76 may be utilized to transfer air or electricity if pneumatic or electrical actuators are employed in lieu of hydraulic cylinder 74.

The cylinder portion 80 of the hydraulic cylinder 74 is connected to the frame 50 of the grader attachment 12 by a mounting bracket 88 disposed on support member 86. The frame 50 of the grader attachment 12 also includes a center support member 92 to provide additional structural support for support member 86. At the opposite end of the cylinder 74, an upper mounting bracket 90 is included on the upper end of the wheel support structure 68 to operably attach the rod portion 78 of the cylinder 74 to the wheel 60 and the wheel structure support 68.

Activation of the hydraulic cylinder 74 causes the wheel 60 to be moved either inwardly closer to the front of the attachment 12 or outwardly away from the attachment 12 by pivoting the wheel support structure 68 about a pivot point 77 on bar 71 to which the wheel support structure 68 is attached. This serves to move the front end of the attachment between an operative, lowered position and an inoperative, raised position.

Figure 2:
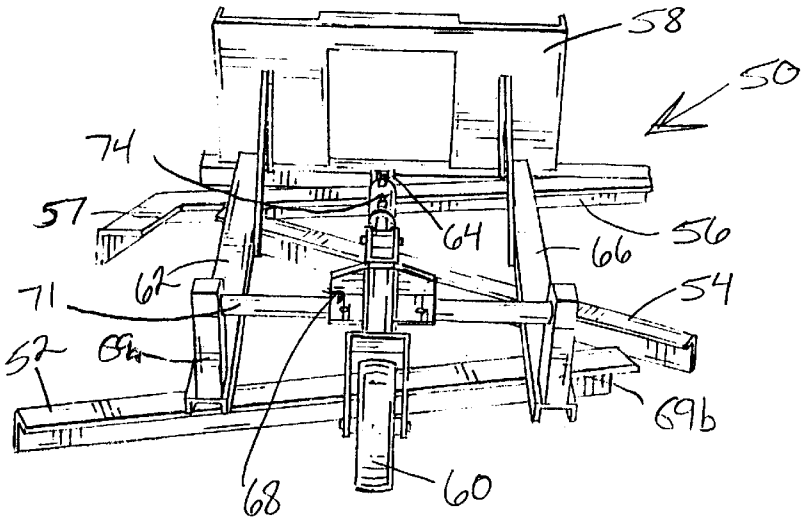
FIG. 2 is a front view of the grader attachment.
Figure 3:
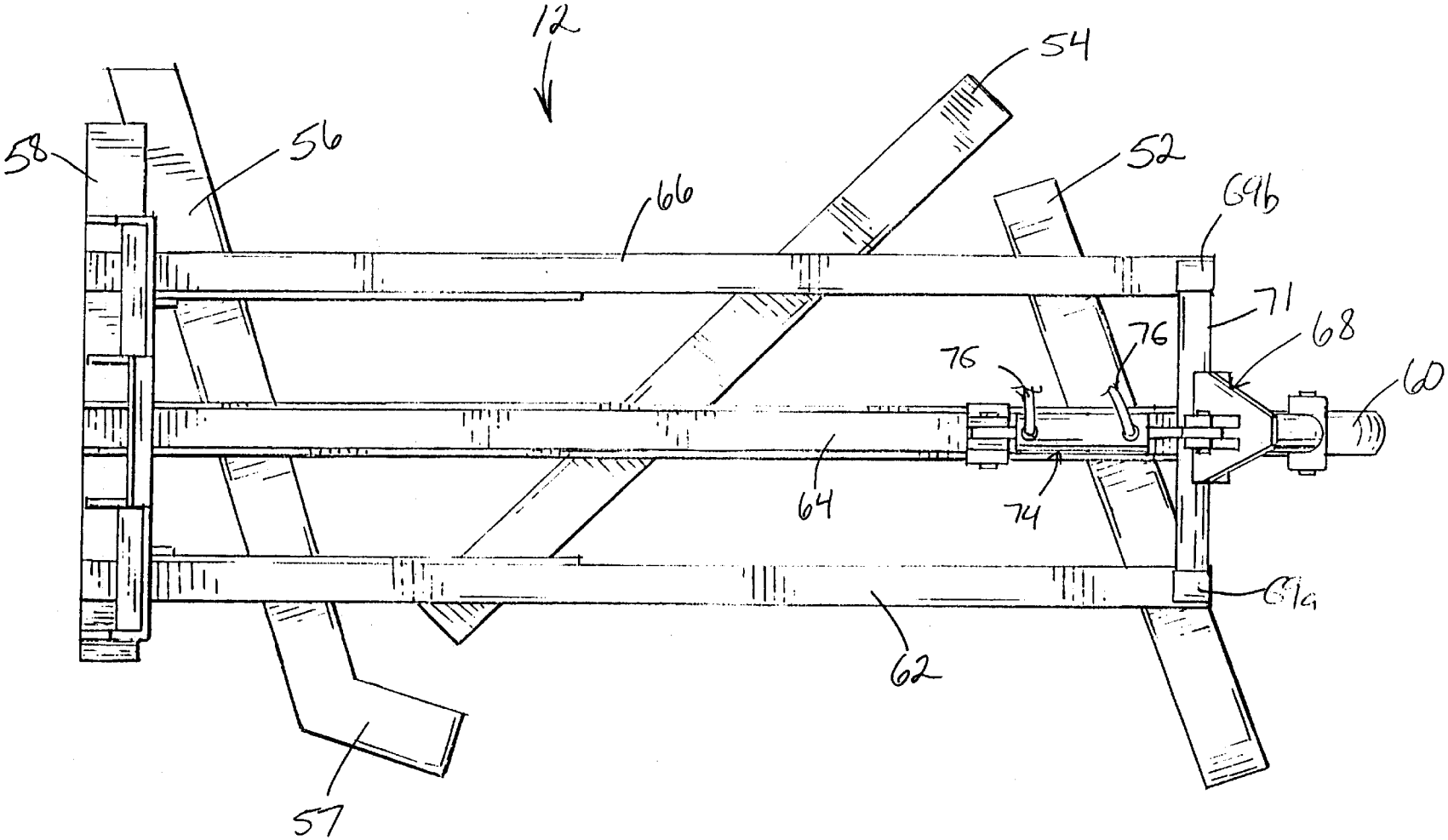
FIG. 3 is a top elevational view of the grader attachment.

FIGS. 2 and 3 illustrate the configuration of the grading blades 52, 54, 56 which are rigidly attached to the bottom of the frame members 62, 64, 66. A first blade 52 positioned at the front of the attachment 12 and located behind the guide wheel 60 is angled inwardly from right to left. A second blade 54 located behind the first blade 52 is positioned to accept the windrow from first blade 52 and is angled from left to right The second blade 54 is angled oppositely from the angle of the first blade 52. A third blade 56 includes an extension 57 on its right end to pick up the windrow from the second blade 54. The third blade 56 is angled inwardly from right to left at an angle substantially equal to the angle of the first blade 52. The configuration of the three blades 52, 54, 56 are preferably fixed, but may be adjustable for different applications.

Figure 4:
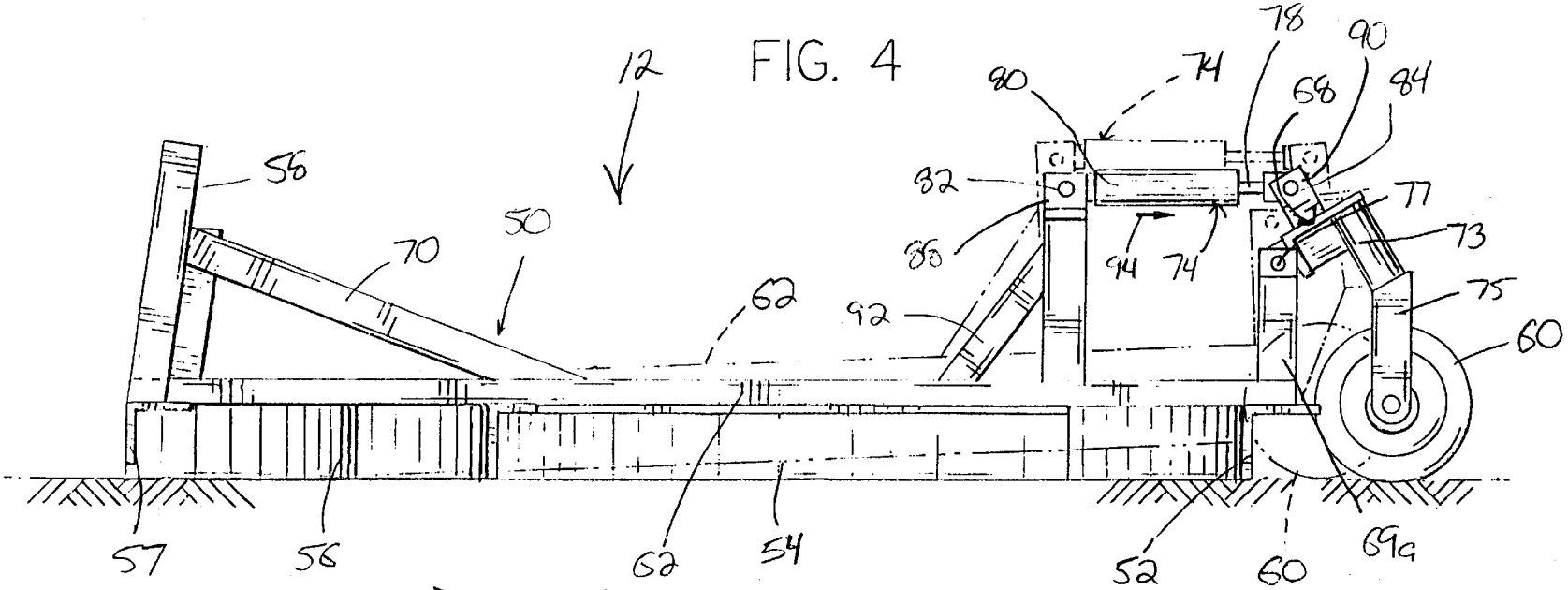
FIG. 4 is a side elevational view of the grader attachment showing height adjustment of the front end of the grader by a hydraulically controlled front wheel.

FIG. 4 illustrates the operation of the hydraulically operated front wheel 60 for raising the front end of the grader attachment 12. When extended, the hydraulic cylinder 74 pushes the wheel support structure 68 and the wheel 60 down to lift the front end of the attachment 12 off the ground. The front end of the grader attachment 12 is movable by action of the cylinder 74 between a raised position (shown in phantom lines in FIG. 4) and a lowered position (shown in solid lines in FIG. 4). In the raised position, the blades 52, 54, 56 extending downwardly from the frame members 62, 64, 66 are raised above the ground. The arrow 94 illustrates the action of the hydraulic cylinder 74 occurring between the front end being on the ground and the front end being lifted off the ground.

While the invention has been described with reference to a preferred embodiment, those skilled in the art will appreciate that certain substitutions, alterations and omissions may be made without departing from the spirit of the invention. Accordingly, the foregoing description is meant to be exemplary only, and should not limit the scope of the invention set forth in the following claims.

I claim:

1. A grader attachment for a skid steer vehicle wherein the skid steer vehicle includes a main body, a lift mechanism attached to a front of the main body, and attachment means extending from the lift mechanism, said grader attachment comprising:

an attachment mechanism for attaching the grader attachment to the front end of the skid steer vehicle, said attachment mechanism including a mounting plate releasably engageable with the lift mechanism;

a frame attached to the attachment mechanism, extending longitudinally therefrom and including at least one wheel rotatably secured at a front end of the frame, the wheel used for raising and lowering the front end of the frame; and at least three blade members attached to and extending downwardly from the bottom of the frame, the blades being angularly configured with respect to each other on the frame to enable a single pass of the grader attachment to completely level a surface to be graded.

2. The grader attachment of claim 1 wherein the wheel is hydraulically operated by a hydraulic cylinder pivotally connected between a wheel support structure located on the frame at the front end thereof, and a support member spaced from the wheel support structure on the frame.

3. The grader attachment of claim 2 wherein the wheel support structure includes a cylindrical member used to rotatably engage a mounting portion of the wheel to rotatably mount the wheel to the wheel support structure.

4. The grader attachment of claim 2 wherein the hydraulically operated front wheel operates to raise and lower the front end of the grader attachment off the ground.

5. The grader attachment of claim 1 wherein the at least three grading blades are attached to extend downwardly from the frame in a configuration where a first blade located at the front of the grader attachment behind the guide wheel is angled inwardly from right to left, a second blade located behind the first blade extends outwardly to accept the windrow from the first blade, the second blade being angled from left to right, and a third blade located behind the second blade and positioned to accept the windrow from the second blade, the third blade angled from right to left.

6. The grader attachment of claim 5 wherein the third blade includes an extension member located at one end thereof for receiving the windrow of the second blade.

7. The grader attachment of claim 5 wherein the first and third blades are angled at substantially the same angle.

8. The grader attachment of claim 2 wherein the second blade is angled at a angle opposite the first and third blades.

9. A grader attachment for a skid steer vehicle, the skid steer vehicle including a main body, a lift mechanism attached to a front of the main body and attachment means for attaching the grader attachment to the lift mechanism, said grader attachment comprising:

a frame including a plurality of frame members extending longitudinally in parallel spaced relation, a mounting plate for releasably engaging the grader attachment with the front end of the lift mechanism, and at least one cross member connected to said frame members at a front end of the grader attachment;

at least three blades extending downwardly from the frame and arranged in an alternately angularly extending configuration along the frame to enable a single pass of the grader attachment to level a surface to be graded; and at least one wheel rotatably attached to the cross-member located at the front end of the grader attachment, the wheel being hydraulically operated to raise and lower the front end of the grader attachment off the ground.

10. The grader attachment of claim 9 wherein the frame members are hollow.

11. The grader attachment of claim 10 wherein the lift mechanism comprises a pair of lifting forks extending from a plate attached to the main body, the lifting forks spaced from one another a distance equal to the distance between outermost frame members such that the lifting forks may be received within the outermost frame members to releasably engage the grader attachment with the lift mechanism.

* * * * *